US008413587B2

(12) United States Patent
Emary

(10) Patent No.: US 8,413,587 B2
(45) **Date of Patent: *Apr. 9, 2013**

(54) CARTRIDGE AND BULLET WITH CONTROLLED EXPANSION

(75) Inventor: David E. Emary, St. Paul, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/453,877

(22) Filed: Apr. 23, 2012

(65) Prior Publication Data

US 2013/0014668 A1 Jan. 17, 2013

Related U.S. Application Data

(63) Continuation of application No. 12/156,771, filed on Jun. 3, 2008, now Pat. No. 8,161,885, which is a continuation-in-part of application No. 11/130,972, filed on May 17, 2005, now Pat. No. 7,380,502.

(51) Int. Cl.
*F42B 12/34* (2006.01)
*F42B 30/02* (2006.01)

(52) U.S. Cl.
USPC ..... 102/506; 102/508

(58) Field of Classification Search ..... 102/501, 102/506, 507, 508, 509, 510
See application file for complete search history.

(56) References Cited

U.S. PATENT DOCUMENTS

| | | | | |
|---|---|---|---|---|
| 7,380,502 | B2 * | 6/2008 | Emary | 102/506 |
| 8,161,885 | B1 * | 4/2012 | Emary | 102/506 |
| 2006/0278114 | A1 * | 12/2006 | Millard | 102/439 |
| 2007/0131130 | A1 * | 6/2007 | Stock et al. | 102/473 |

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

A bullet or a cartridge containing a bullet having an elongated body with a forward end and an opposed rear end. The body has an intermediate cylindrical portion between the rear and forward ends, and the front end of the body defines a cavity. A resilient nose element is received in the cavity. The nose element may be an elastomer, and may be a cylindrical body. The cavity may be a cylindrical bore, and the nose element may be closely encompassed within the bore. The forward end of the nose element may be flat, and may be flush with the forward end of the body.

20 Claims, 6 Drawing Sheets

FIG. 6 Tip Harness
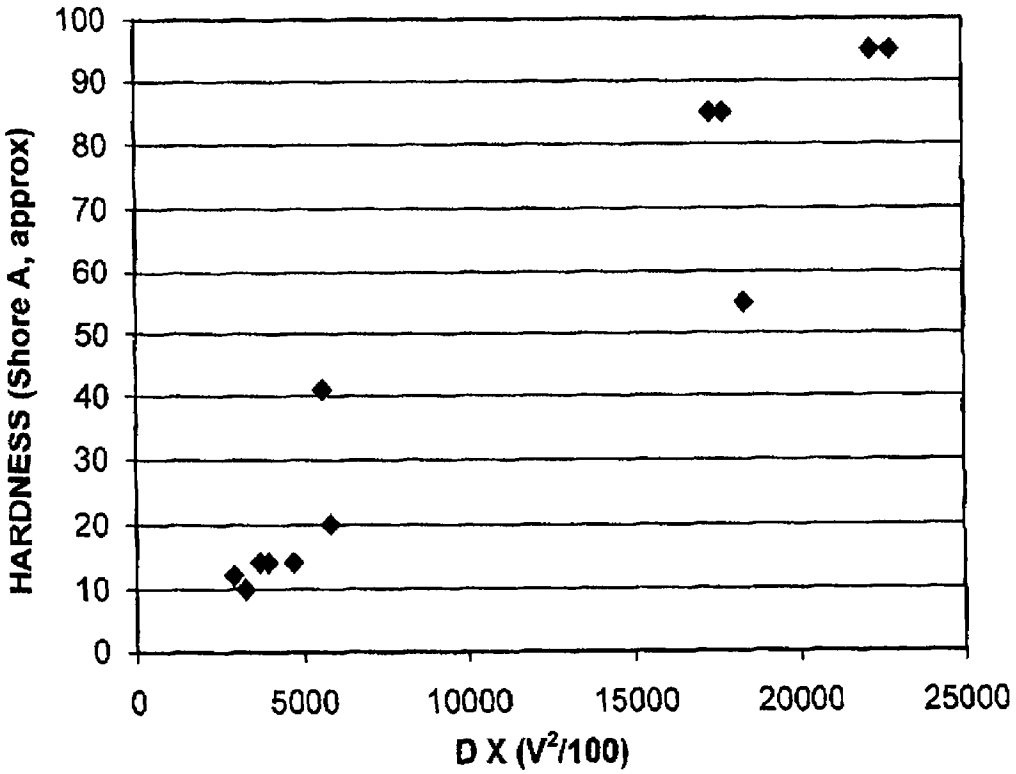

CARTRIDGE AND BULLET WITH CONTROLLED EXPANSION

REFERENCE TO RELATED APPLICATION

This is a Continuation of U.S. patent application Ser. No. 12/156,771, filed Jun. 3, 2008 now U.S. Pat. No. 8,161,885, entitled "CARTRIDGE AND BULLET WITH CONTROLLED EXPANSION," which is a Continuation-in-Part of U.S. patent application Ser. No. 11/130,972, filed May 17, 2005, now issued as U.S. Pat. No. 7,380,502, entitled "CARTRIDGE WITH BULLET HAVING RESILIENT POINTED TIP."

FIELD OF THE INVENTION

This invention relates to firearms ammunition, and more particularly to cartridges and bullets with expanding characteristics.

BACKGROUND AND SUMMARY OF THE INVENTION

Many popular types of rifles such as lever action rifles employ tubular magazines, in which a single line of cartridges is stored in a cylindrical tube parallel to and just below the rifle barrel. The cartridges are arranged nose first, with a compressed spring and piston forward of the nose of the forward most cartridge. The spring pressure transmits through the row of cartridges, and forces the rear most cartridge into the action when the action is cycled.

Because the nose of each cartridge in the tube presses against the rear of the next cartridge, this raises a critical safety concern. Centerfire cartridges have primers centered on the base of the cartridge, and it is essential to ensure that the nose of one bullet does not act like a firing pin that strikes the primer of the next bullet. Such forces can occur if a rifle is dropped, such as from an elevated tree stand, or from recoil upon discharge. Thus, sharply pointed bullets common to other types of rifles employing box magazines (in which the cartridges are positioned side-by-side) are not suitable for tube-magazine rifles.

Rifles with tubular magazines are limited to rimfire cartridges (which do not have a central primer and require a sharp pinching of the rim to discharge) and to centerfire cartridges having broad flat noses. Blunt, rounded nose bullets have been employed, but these are regarded as more risky than flat nosed bullets. Typically, the flat nose of a suitable bullet has a diameter of approximately 60% or greater than that of the primer. This ensures any force transmitted to the primer is distributed over a large enough area to ensure that primer discharge will not occur. Cartridges with heavier bullets generally have larger diameter flat noses, to account for the increased force that the added mass of a stack of cartridges can generate upon dropping a loaded rifle, and the increased recoil associated with such cartridges. The noses of such bullets are generally formed of exposed lead and are not fully jacketed to provide further safety.

While effective to ensure safety, flat nosed or other blunt bullets are aerodynamically inefficient compared to the sharply pointed bullets used in other rifles. This means that they lose more velocity as a function of distance traveled than a sharp pointed bullet, due to increased air resistance. This effect is greatest over longer distances. Because of this higher rate of velocity loss blunt bullets carry less energy downrange than do pointed bullets. In addition, the reduced velocity at distance leads to greater bullet drop and crosswind drift, requiring more compensation by and opportunity for error from the shooter.

A suitable safe, blunt bullet for a tubular rifle magazine will generally have a ballistic coefficient (BC) of approximately 0.200 depending on the caliber and weight of the bullet. Sharply pointed bullets, of comparable caliber and weight, have BC values typically of 0.250 to 0.350. Thus, a lever action rifle chambered in 30-30 Winchester is considered effective for deer hunting only out to about 100-150 yards, while cartridges with spire-point bullets of comparable weight and muzzle velocities are effective for deer beyond 250 yards.

For applications other than tube-feed rifles, it is often important that bullets have an expansion capability. An expanding bullet is often more effective to disable or stop the intended target. For hunting, this means a more lethal and humane effect on game. For self defense, police, and military applications, it means that an attacker is more readily incapacitated, ending the attack.

One common type of expanding bullet is a hollow point bullet. This has a central cavity or opening at the nose of the bullet, which facilitates the hollow forward end flaring outward upon impact to create a broader profile. This is more disruptive of tissue, providing the increased effectiveness. However, hollow-point bullets have certain disadvantages. The amount by which the bullet expands is critical, with under- and over-expansion limiting effectiveness. If the bullet does not adequately expand, then it has less disruptive effect leading to reduced stopping power, and may over penetrate the target, endangering bystanders or at least limiting effectiveness by failing to deliver some of the bullet's energy to the target. An over-expanded round delivers all its energy to the target, but has limited penetration. This also diminishes the intended effectiveness against targets.

Moreover, if a criminal attacker is wearing heavy clothing such as denim or leather, the material may clog up the hollow point, preventing or substantially reducing expansion. Other problems with conventional hollow point bullets is that an off-axis impact on hard material such as sheet metal or glass can tend to cause the hollow point leading edge to bend, closing it up and preventing expansion upon eventual impact with the target.

Some bullets have hollow points formed in the bullet body (typically formed of a lead alloy with a copper alloy jacket) and with the hollow cavity filled with an element of a different material. Rifle bullets may have a hollow cavity filled with a pointed tip element to provide an aerodynamic profile, and which facilitates expansion upon impact at high velocities. Certain pistol bullets employ a round plastic ball that partially fills a bullet's cavity, preventing clogging with clothing material, and facilitating expansion. While providing some benefits, there remains a need to generate more effective and controlled expansion of bullets.

A particular concern is that while high-velocity rifle bullets readily expand upon impact, lower velocity rounds expand less reliably. This is a particular concern for compact pistols with short barrels in smaller calibers often carried for self defense. In certain calibers, even a hollow-point round not suffering from clogging with clothing material may not expand sufficiently. Moreover, a bullet designed for expansion at lower velocities may excessively expand when fired from a gun with a longer barrel generating higher muzzle velocity.

The present invention overcomes the limitations of the prior art by providing a bullet or a cartridge containing a bullet having an elongated body with a forward end and an opposed rear end. The body has an intermediate cylindrical portion between the rear and forward ends, and the front end of the body defines a cavity. A resilient nose element is received in the cavity. The nose element may be an elastomer, and may be a cylindrical body. The cavity may be a cylindrical bore, and the nose element may be closely encompassed within the bore. The forward end of the nose element may be flat, and may be flush with the forward end of the body.

BRIEF DESCRIPTION OF THE DRAWINGS

FIG. 6 is a graph illustrating the parameters for various caliber bullets according to the third alternative embodiment of the invention.

DETAILED DESCRIPTION OF A PREFERRED EMBODIMENT

Figure 1:
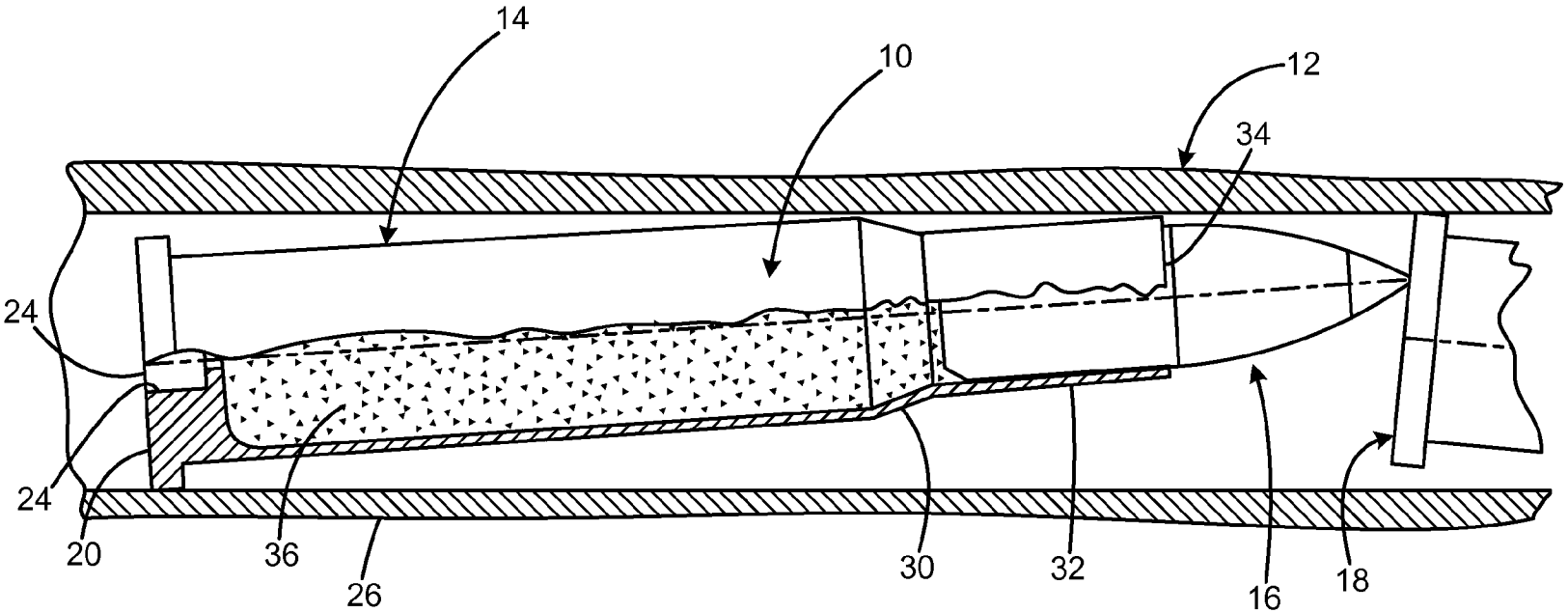
FIG. 1 is a sectional side view of a rifle cartridge according to a preferred embodiment of the invention.
Figure 2:
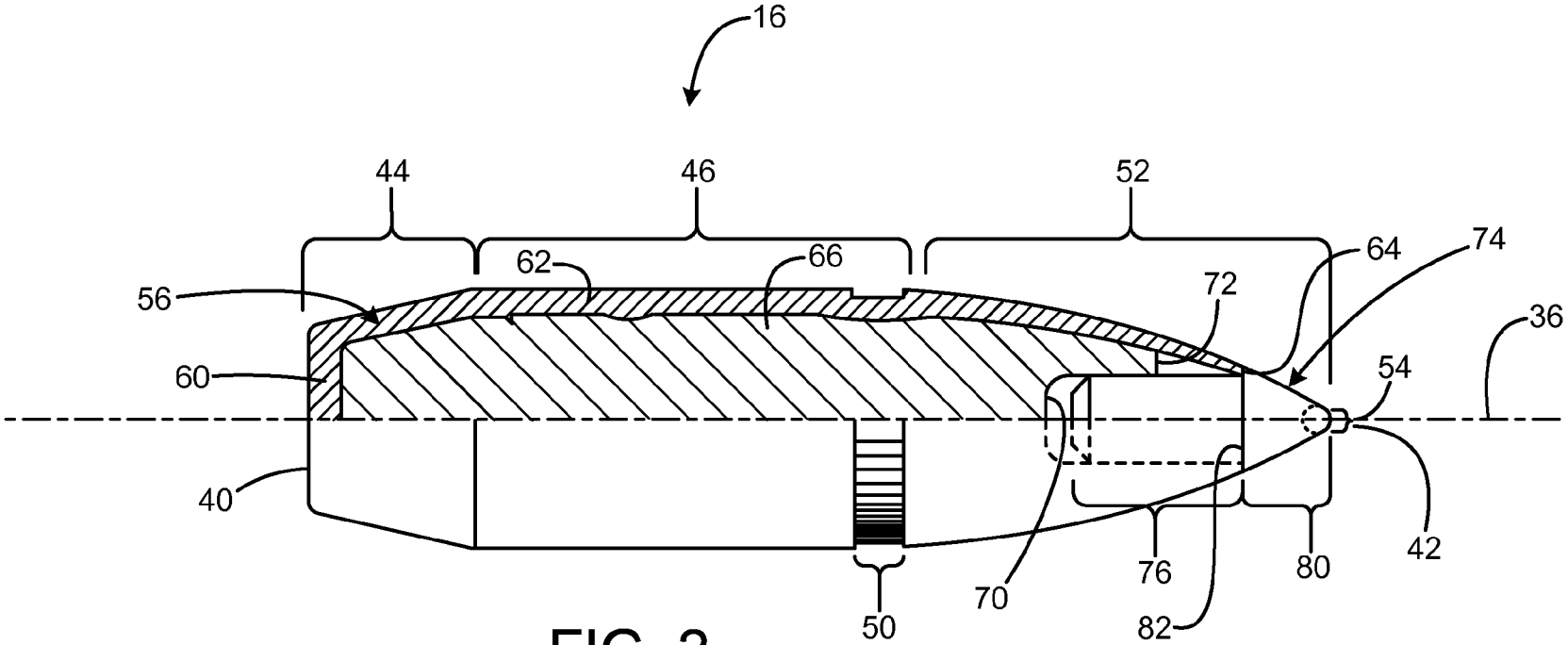
FIG. 2 is a sectional side view of a bullet according to a preferred embodiment of the invention.

FIG. 1 shows a rifle cartridge 10 as loaded in a tubular magazine 12 typically attached below the barrel of a lever-action rifle. The cartridge has brass case 14, and a bullet 16. The case has a circular rear end 20 defining a central pocket 24 into which is inserted a primer. The case has side walls 26, and can have a tapered shoulder 30 leading to a reduced diameter neck, or nearly straight sidewalls that end in a forward case mouth 34. The case contains a quantity of powder 36, which is contained by the bullet 16 being partially inserted into the mouth, which is crimped to secure the bullet in place. The rear of a second cartridge 18 is shown, positioned just forward of the cartridge, illustrating how in many instances, the tip of one bullet can be positioned against the primer of the next cartridge.

The bullet 16 is a generally cylindrical body, symmetrical in rotation about an axis 36, with a rear end 40 and a forward tip 42. The bullet has an exterior surface shaped as follows: A rear portion 44 has a tapered frustoconical "boat tail" surface; a cylindrical intermediate portion 46 continues forward from the rear portion with a straight cylindrical side wall that has a circumferential cannelure channel 50. Continuing, a forward ogive surface portion 52 has a gentle curve toward a meplat portion 54 at the tip. The meplat is a small diameter spherical portion. The ogive has a larger radius (as taken in a plane including the bullet's axis, as illustrated) than the intermediate section's diameter (taken in section across the axis), and also a much larger radius than that of the meplat, as will be quantified below.

The bullet is formed of a copper jacket 56 having a base portion 60, with side walls 62 extending forward to a rim 64 at a forward position on the ogive section, spaced apart from the meplat. The jacket closely surrounds a lead core 66 that defines a cylindrical cavity 70 in a forward face 72 of the core. The forward face is rearward of the jacket edge 64 in this particular embodiment, and the cavity is concentric with the axis 36.

The bullet tip is formed by a nose element 74 having a first shank portion 76 and a second tapered portion 80 formed as a unitary body of the same material. The shank portion is a cylindrical portion having a diameter equal to the diameter of the jacket rim, and which is closely received in the cavity of the core. The second portion has a larger diameter than the shank at its base adjacent to the shank. The base of the second portion forms a shoulder 82, and tapers to form the tip. The jacket rim tightly grips the base of the shank at the shoulder, to secure the nose into the bullet body.

The nose element is formed of a resilient material that elastically returns to its illustrated configuration after substantial compression. In the preferred embodiment, the resilient material is an elastomer with a Shore-A hardness of 80, such as Texin 285, an aromatic polyester-based thermoplastic polyurethane from Bayer Material Science AG, Leverkusen, Germany. The term "resilient" is used herein to distinguish from materials (including most thermoplastics and common ammunition metals such as copper or lead) that are essentially rigid, even if they will undergo slight elastic deformation from which they may recover without permanent distortion.

The hardness of the elastomer may vary from the preferred hardness. A lower limit is required to avoid a nose element that is so soft it does not withstand anticipated forces, and essentially allows the next cartridge to make a high energy strike against the jacket rim. In addition, too-soft material is more readily inadvertently removed from the bullet, which would result in a less-safe (and poor-performing) cartridge if used. A lower threshold hardness of Shore-A 60 is considered minimal, and a lower threshold of 70 is believed more suitable for most applications. If the material were too hard, it would generate concentrated forces at the tip that would behave in the unsafe manner of a conventional hard plastic or metal tip, with inadequate flexure to absorb energy and to compress into an adequately broad tip. An upper threshold hardness of Shore-A 95 is considered as a maximum, and an upper threshold of 85 is believed more suitable for most applications.

While a generally rigid plastic that may compress to less that 90% of its length without permanent deformation may in some senses be resilient, it is not considered resilient for the purposes of this disclosure, which contemplates substantial resiliency in the manner of an elastomer that can be compressed to less than 50% of its length repeatedly without permanent deformation. For this disclosure, "resilient" materials include rubber, silicone and any other synthetic or natural elastomer, as well as composite elements including more than one material, and/or with complex forms, including metal or other springs, compressible gas-filled bladders or bellows, and the like. Such elements may be used to construct a "resilient" nose element body, even when they include materials that would not be considered "resilient" if employed in monolithic form.

The essential function of the resilient nose is to prevent the discharge of the primer of the next cartridge 18 in the event the rifle is dropped on end, or in response to recoil forces. In the case in which a tubular-magazine rifle is dropped on the butt-stock, the entire mass of all the cartridges forward of the rearmost cartridge generates a substantial inertial force on the second-to-rearmost cartridge as it rests against the tip of the rearmost cartridge. If this force were concentrated over the small diameter of a metal-tipped bullet's meplat, or the meplat of a bullet tipped with a substantially rigid thermoplastic, this would generate a high force concentration that may be adequate to discharge a primer. However, in the preferred embodiment, the tip readily compresses to a broader, blunter tip, so that forces from recoil or a drop from a threshold height are distributed over a much broader area, limiting forces to a safe level below that needed for discharge. Under substantial force, the resilient tip of the preferred embodiment is believed to compress to an area of contact comparable to, or a significant percentage of that of the typical rifle primer.

Pointed plastic tips are common in rifle bullets. However, these are selected to be as rigid as possible, and not used in tube-magazine rifles. The rigidity is preferred to avoid damage to the tip during handling and loading, which will generally reduce accuracy by creating a non-uniform aerodynamic shape, and possibly introducing eccentricities in the bullet mass. Thus, the use of softer or more flexible materials is counter to the normal objectives of bullet design.

The use of a tapered or pointed tip provides a much higher ballistic coefficient than a conventional flat-tipped bullet normally required for tubular-magazine rifles. The overall shape with the resilient tip is that of a conventional high-performance spitzer, soft point hunting bullet, with a jacket that comes to an essentially sharp point (with a small meplat.) In alternative embodiments, the resilient tip and bullet shape may be selected to provide any desired bullet surface profile, using the tip as needed to alleviate the safety concerns discussed above.

In the illustrated embodiment, the example of a 30-30 Winchester cartridge is shown. The casing is a rimmed centerfire (not rimfire) design, although non-rimmed, rebated, and belted centerfire casings may also be employed. The bullet is elastomer tipped, 165 grains, lead core, and copper jacketed, with an overall length of 1.100", and an overall diameter of 0.308 inch. The length of the ogive section is 0.470 inch, and this section has an ogive radius of 1.50 inch. The exposed portion of the nose has a length of 0.101, which is 21% of the total ogive length. In alternative embodiments, a straight conical form would be considered to have a large radius of infinite amount, for purposes of comparing with other dimensions of the bullet. The meplat has a radius of 0.018 inch. The diameter of the meplat at the transition to the ogive section is about 0.030 inch, and the diameter of the largest portion of the ogive portion at the shoulder is 0.131 inch. This is a ratio of meplat diameter to ogive portion diameter of greater than 4, which provides a very aerodynamically efficient sharply pointed profile.

In alternative embodiments, a purely spherical resilient tip (all meplat) would be less aerodynamically efficient, and would have a ratio of 1, it would provide ballistic advantages over a flat tip as well as safety advantages over a conventional round tip. Preferably, the ratio is at least 1. The ratio of the ogive radius to the meplat radius is 37. If the tip surface were spherical, the ratio would be 1. Any ratio greater than 1 provides some aerodynamic benefits, but a ratio in excess of 3 is preferred. For a spire-point bullet having a straight conical forward portion terminated by a small meplat, (with part of the conic portion provided by the nose element) the straight portion is considered for the purposes of this disclosure to have an infinite ogive radius.

The diameter of the nose element at the base of the ogive portion (the same as the jacket forward rim diameter) must be large enough to provide safety, so that there is an adequate volume of resilient material to absorb the necessary energy based on a function of expected forces. For larger cartridges with heavier bullets, greater forces are expected, and thus the nose element diameter must be greater. The 30-30 cartridge with the 165 grain bullet has a ratio of nose element diameter to bullet diameter of 0.131/0.308 or 43%. A ratio of approximately 30 to 35% is considered minimum. For larger/heavier bullets, this ratio is generally greater.

In alternative embodiments, the tip may have any non-spherical shape and still be considered "pointed." Such shapes include those with parabolic, hyperbolic, conical or ellipsoidal sections, or any combination of these or other non-spherical surfaces of revolution. Certain bullets with a laterally flattened tip may also employ the resilient tip shape of the preferred embodiment, even though they are not surfaces of revolution.

In further alternatives, the resilient tip may have a flange or skirt that extends rearward of the shoulder, so that a forward jacket portion is closely covered by the skirt.

Figure 3:
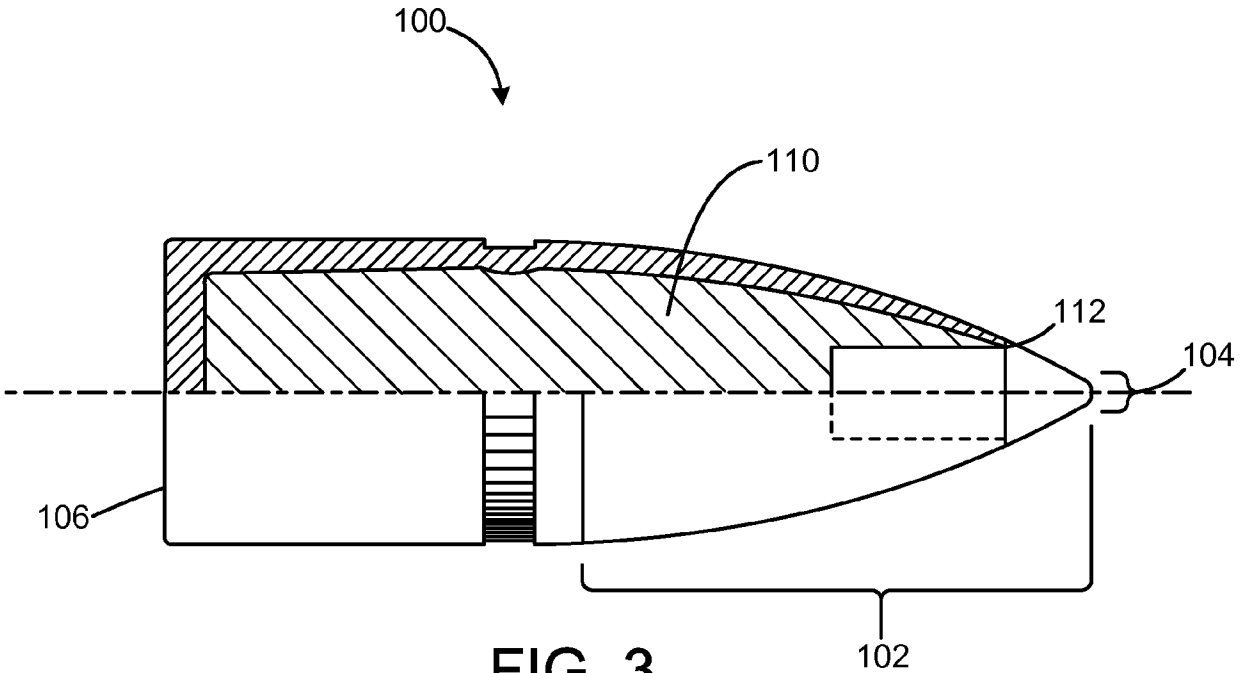
FIG. 3 is a sectional side view of a bullet according to a first alternative embodiment of the invention.

FIG. 3 shows a bullet 100 for the 35 Remington caliber. The bullet is elastomer tipped, 200 grains, lead core and copper jacketed, with an overall length of 1.030 inch, and an overall diameter of 0.358 inch. The length of the ogive section 102 is 0.560 inch, and this section has an ogive radius of 1.75 inches. The exposed portion of the nose has a length of 0.101, which is 18% of the total ogive length. The meplat 104 has a radius of 0.018 inch. The diameter of the meplat at the transition to the ogive section is about 0.030 inch, and the diameter of the largest portion of the ogive portion at the shoulder is 0.131 inch. This is a ratio of nose element diameter to bullet diameter, as mentioned above, of 37%. The bullet 100 has a flat base 106 without a boat tail, and the lead core 110 extends forward to just rearward of the forward rim 112 of the jacket.

Figure 4:
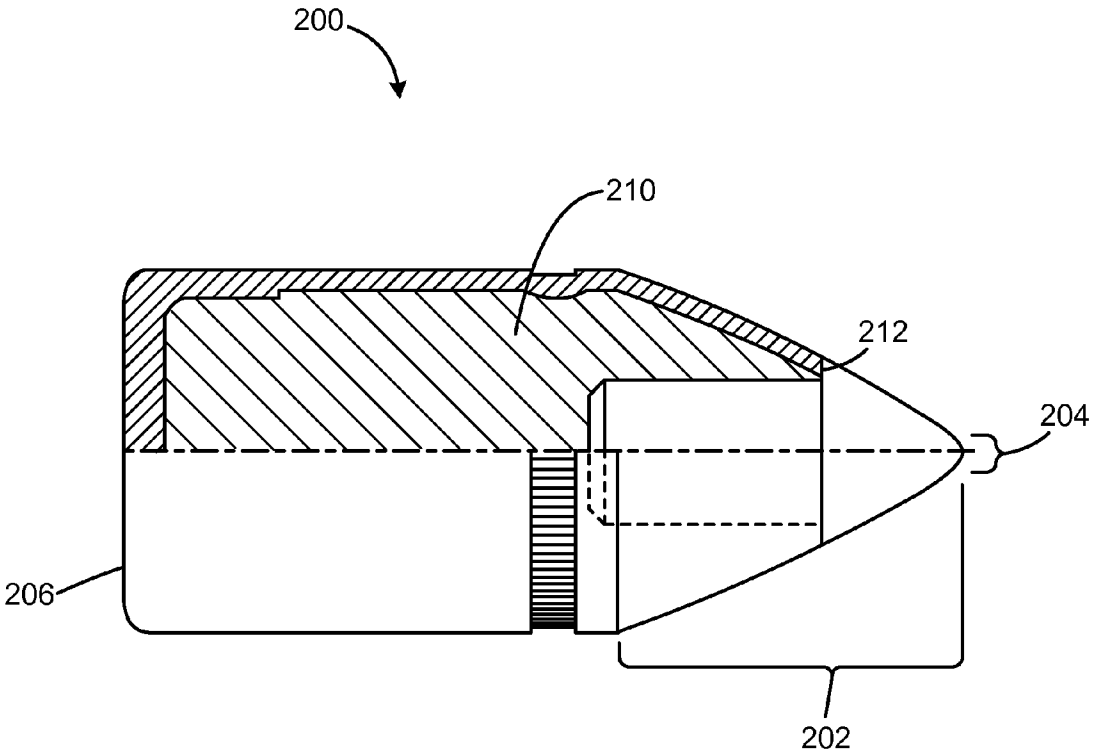
FIG. 4 is a sectional side view of a bullet according to a second alternative embodiment of the invention.

FIG. 4 shows a bullet 200 for the 45-70 or 450 Marlin calibers. The bullet is elastomer tipped, 325 grains, lead core and copper jacketed with an overall length of 1.050 inches, and an overall diameter of 0.458 inch. The length of the ogive section 202 is 0.400 inch, and this section has an ogive radius of 1.50 inches. The exposed portion of the nose has a length of 0.173, which is 43% of the total ogive length. The meplat 204 has a radius of 0.02 inch. The diameter of the meplat at the transition to the ogive section is about 0.035 inch, and the diameter of the largest portion of the ogive portion at the shoulder is 0.235 inch. This is a ratio of nose element diameter to bullet diameter of 51%. The bullet 200 has a flat base 206 without a boat tail, and the lead core 210 extends forward nearly to the forward rim 212 of the jacket.

The performance advantages provided by the sleek or pointed shapes generated by the resilient tips are comparable to the performance of plastic or metal tipped bullets of the same shape.

Alternative Embodiment Expanding Bullet

Figure 5:
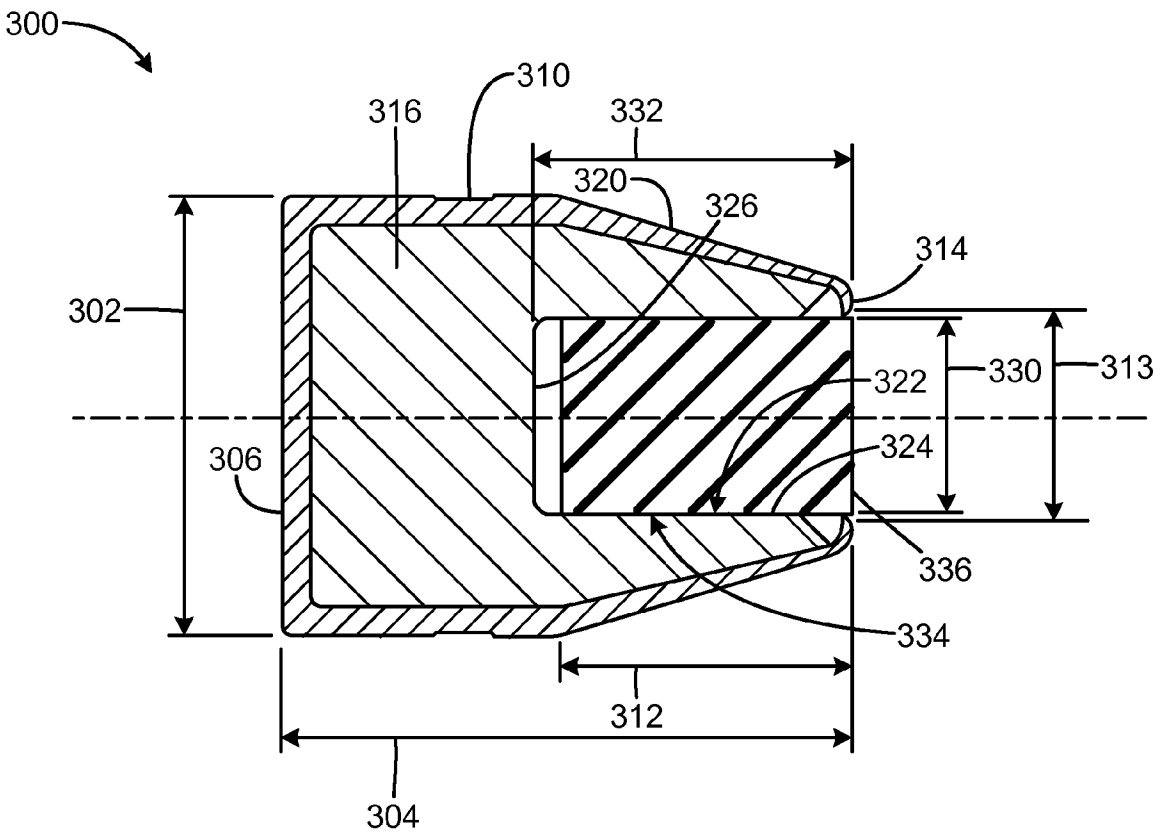
FIG. 5 is a sectional side view of a bullet according to a third alternative embodiment of the invention.

FIG. 5 shows an alternative embodiment bullet 300 that differs from the embodiments above in that it does not have a pointed tip. Pointed tip bullets are especially useful for very high-velocity applications associated with rifles, where muzzle velocities on the order of 2000-3000 feet per second are most common. At these velocities, aerodynamics of the bullet are important in determining effective range, because less streamlined bullets with low ballistic coefficients will shed velocity faster, limiting the effective range (reducing the velocity at a given distance).

For other applications not involving distant targets, bullet shape and ballistic coefficient are less critical. Blunt, round-nosed, and flat-nosed bullets are commonly used for many applications. Handgun bullets are typically employed at shorter ranges than are normal rifle bullets. Targets are usually well within 100 yards, while many rifle bullets are intended for targets at several hundred yards. Thus, loss of velocity over the flight distance is not a significant concern, and blunt-tipped bullets are often employed. Blunt tipped bullets allow the more efficient use of limited cartridge volume constraining handgun design, by pushing more bullet mass out to the forward corners of the envelope, and pushing the bullet of a given weight farther forward to provide more case volume for propellant powder.

Handgun bullets are typically propelled at much lower velocities that typical rifle bullets, with velocities under 1000 feet per second (fps) at the low range, while most common handgun rounds used by common self defense pistols being below 1500 fps, and few if any pistol bullets being intended for velocities over 2000 fps. For instance, the standard velocity for bullets fired from pistols with standard (4") barrels in the most common self-defense and police calibers of .380 ACP, 9 mm, 38 Special, 40 S&W, and .45 ACP ranges from 800 to 1,100 fps. At these much lower velocities, expanding bullets such as hollow points do not reliably expand due to the limited energy available upon impact to cause expansion. To ensure expansion, bullets must be designed with features that weaken them more than may be desirable, or which may generate excess unwanted expansion that limits effectiveness on the target.

Handgun bullets also generally have substantially lower sectional densities compared to rifle bullets. Sectional density (SD) is defined as the bullet weight in pounds divided by the square of the diameter in inches. Many common handgun bullets have SD values on the order of 0.100, with few having SD values over 0.200. Typical pointed rifle bullets have SD values on the order of 0.200-0.300 or above.

While handgun bullets and rifle bullets generally have these different characteristics, there may be some overlap at the extremes of each group. Some bullets are used for both handgun and rifle rounds, and some cartridges are also commonly chambered in both kinds of firearms. Thus, what may be described as a typical handgun bullet is not limited only to that application. The principles of the invention are intended to apply to any bullet or cartridge where controlled expansion is desired. Blunt-tipped bullets are the typical application, but this is not necessarily the only useful application. For instance, the pointed tip bullets described above were developed to provide long-flying (high ballistic coefficient) bullets for tube feed rifles where pointed tip bullets were previously considered unsafe. However, during testing and evaluation of these bullets, it was discovered that the elastomeric core provided the unexpected benefit of controlling expansion of the bullet upon impact, as will be discussed below.

The bullet illustrated in FIG. 5 is a 9 mm caliber, with specific characteristics and dimension as listed below. It has an overall diameter 302 formed by a cylindrical rear portion having a length 304. The rear portion extends to the base 306, which is a flat surface extending the full diameter of the bullet, except for only a limited minimal radius at the periphery. The rear portion has a circumferential groove or cannelure 310 for engagement by the crimped mouth of a casing that receives the bullet to form a cartridge. The bullet has a tapered forward portion having a length 312, and tapering to reduced flat nose diameter 313 at a forward rim 314.

The bullet has a lead alloy core 316 forming the bulk of the bullet's mass, and a copper alloy jacket 320 encompassing the core and defining the bullet's exterior dimensions. In alternative embodiments, the bullet may be made of any conventional material and construction, and the novel aspects of the disclosed embodiment may be applied to future bullet materials and constructions that may be developed. In particular, the bullet may be made of a single material such as a solid lead alloy or a solid copper alloy.

The bullet defines a central cavity 322 open to the forward end of the bullet. The cavity has a straight cylindrical sidewall 324, and a flat circular floor 326. In alternative embodiments, the sidewall may have other features, such as score lines to facilitate expansion, or may have a polygonal cross section for a similar effect. The cavity has a diameter 330, and a depth or length 332 as measured from the forward most bullet rim 314 to the floor 326. In the illustrated 9 mm embodiment, the cavity has a depth slightly more than the overall bullet length, and a diameter of slightly less than the bullet diameter. Cavity and cavity insert length to diameter ratio is typically at least 1.5 to facilitate manufacture.

The bullet has a nose element or insert 334 that substantially fills the cavity. The insert is formed of an elastomeric material as described with respect to earlier embodiments, but may have different parameters for particular bullet designs and intended uses. In the preferred embodiment, the insert is a straight cylindrical body having flat front and rear end faces perpendicular to the insert axis. The front face 336 is positioned flush with the front of the bullet body, and may optionally be molded with an identifying indicia such as a manufacturer brand, and model identifier, a caliber identifier, or other indicia. The insert may be formed of any color material, with the color optionally being associated with a brand identity, or indicating other characteristics of the bullet or cartridge. To provide for manufacturing without the orientation of the insert being critical, both ends of the insert are the same, providing symmetry as the ends may be exchanged prior to insertion into the cavity. The length of the insert is designed to be slightly less than the cavity depth (by 0.020), so that dimensional tolerances may be accommodated on assembly to ensure a flush insert front face. The circular cross-section allows insertion of the insert irrespective of rotational orientation, simplifying manufacturing.

FIG. 6 shows a graph illustrating the results of experimentation providing desired expansion performance for various calibers The Y axis shows Shore-A hardness of the insert, and the x axis shows the product of the bullet's diameter, times the square of its velocity, divided by 100. This illustrates a diagonal band of desired performance, above which expansion is excessive, and below which expansion is inadequate. For any new caliber, the hardness of the insert that will provide optimum expansion is a Shore A value of $1/250^{th}$ of (0.004 times) the X-Axis velocity function of $D \times V^2/100$. Thus, the Shore A value$=D \times V^2/25000$. Where D is in inches, and V is in Feet per second. There may be variants, as sometimes exponentiation suggests moderate deviations of Shore A from this nominal value, such as $1/140$ of the X function for the caliber at approximately 5800 and 41.5, and $1/325$ for the caliber at approximately 18000 and 55. Preferably, the ratio will be between $1/100$ and $1/500$ for most or all typical calibers.

In alternative embodiments, the insert may have alternate shapes. The end faces may be concave or convex. The insert's forward face may protrude from or be recessed in the cavity, instead of the illustrated flush appearance. Recessing the insert will make it more vulnerable to clogging with clothing, and causing it to protrude will generally reduce cartridge performance for a given overall length. A protruding tip may provide aerodynamic benefits as discussed in earlier embodiments. If a rounded bullet nose is desired, the insert may be provided with domed ends. Preferably, to avoid excessive protrusion, any protrusion is limited to less than the insert diameter. Where the inserts are readily oriented before insertion, the ends may have different characteristics, such as one end flat, and one domes, or the forward end having an extending flange to cover the nose rim surfaces of the bullet, to provide enhanced feeding and to prevent damage. The insert may also have a polygonal cross section such as a hexagon in alternative embodiments, As a general rule for a desired level of expansion, as the velocity of the bullet increases the size of the cavity and the insert should decrease and the insert hardness should increase. For low velocity pistol and revolver cartridges, such as the 380 ACP, 45 ACP and the 38 Special, it has been found that a softer material of 50-80 Shore A hardness provides very good expansion performance. For the lowest velocity cartridges with velocities in the 700-800 FPS range, a hardness of no more than 55 Shore A preferred. For higher velocity ammunition handgun and comparable bullets with velocities of 1,200 to 1,500 FPS, a hardness of at most 80 Shore A is preferred.

As the velocity of the bullet increases, increasing hardness of the insert is generally provides desired performance. For typical rifle bullets of 2,500-3,000 feet per second it has been found that materials of 55-80 Shore D hardness provide optimum results. Cavity and insert L/D generally runs 1.25-1.75 for desired results.

Below is an example of a bullet illustrating the principles of the invention.

Intended cartridge caliber: 9 mm (Illustrated to scale in FIG. 5)

Bullet diameter (302): 0.355

Rear portion length (304): 0.210

Forward portion length (312): 0.239

Diameter (313) of nose: 0.170

Cavity diameter (330): 0.155

Cavity length (332): 0.250

Cavity length/diameter ratio 1.61

Experimentation employing the principles of the above invention has shown that by using a relatively soft elastomeric insert, or protruding tips with an extension shank to fill a cavity in the bullet, the terminal expansion performance of these bullets can be dramatically improved and tuned to the specific bullet, velocities and application. The size of the hollow cavity and insert, and length to diameter ratio (L/D) and hardness of the insert can all be adjusted to attain the desired terminal performance and change the terminal performance for a desired effect.

An engineer skilled in the art of bullet manufacturing can adjust many or all of these parameters to create prototypes of varying characteristics, and then test these prototypes by firing into a flesh-simulation medium such as gelatin. If overexpansion is found, the insert hardness may be increased, or the length/diameter ratio may be increased. If underexpansion is found, the converse may be tested. Different bullet alloys and materials may be similarly tested and compensated for. Bullets for cartridges for longer barrel (higher velocity) firearms may be tuned with parameters to limit expansion, than for shorter barrel applications. Bullets for cartridges loaded for higher velocities (even of the same nominal caliber) may be designed with suitable parameters that differ even for bullets of otherwise identical characteristics of shape and weight.

The mechanism that is believed to control the expansion performance is that the insert fills the large cavity in the nose of the bullet and distributes the forces present when the bullet encounters an expansion media (such as flesh). The insert fills the cavity and prevents the impact forces from causing the cavity to expand all at once. The flexible insert is believed to transmit the hydro-static forces of initial impact to the entire cavity, but prevents the entire cavity from experiencing these forces all at one time. The end result is believed to be that the cavity achieves the same expanded bullet diameter as a cavity without the insert but this expansion is spread out over a much greater distance and time.

This results in a wound cavity of the same diameter as a conventional hollow point bullet without the insert, but the large wound cavity diameter extends to a much greater depth, and the total penetration of the bullet is much greater. Essentially, by deferring expansion, greater initial penetration may be achieved, with the expansion deferred but not diminished. It is believed that the insert prevents the cavity in the front of the bullet from opening all at once and acting like a parachute, which would cause the bullet to rapidly lose its momentum and limit its effectiveness and penetration.

The relatively soft elastomeric material employed provides design flexibility and bullet performance that cannot be achieved by any other known means. The hollow cavity, insert design, cavity L/D ratio, and the hardness of the insert can all be adjusted to optimize the performance of a specific bullet depending on the bullets velocity, caliber, jacket design and core hardness.

Terminal performance of existing hollow point pistol bullets can be significantly improved by placing a larger hollow cavity in the nose of the bullet, filled with a relatively soft elastomeric insert. Testing has shown increases in expanded diameter of low velocity pistol bullets of 10-25% depending on the bullet. Expansion media temporary cavities have been increased in diameter by 15-25% and in depth by 25-50% without substantial reduction in total bullet penetration. The same bullet with the same hollow cavity without the insert exhibits similar temporary cavity diameters but lacks the increase in cavity depth and typically loses 25% in total penetration. Higher speed rifle bullets have shown 10-25% larger temporary cavity diameter and 25-50% deeper wound cavities with higher retained weight and penetration than comparable bullets without a soft polymer tip or cylinder/shank.

The relatively soft elastomeric insert also has terminal performance benefits for pistol and revolver bullets for Law Enforcement applications. The insert in the hollow cavity prevents the cavity from being plugged by clothing and thereby preventing cavity expansion, which would drastically reduce the terminal performance effectiveness of the bullet. The insert also prevents the hollow cavity from collapsing when the bullet strikes sheet metal, such as a car door. When typical hollow point bullets strike sheet metal, they have the hollow cavity crushed shut, and upon exiting the sheet metal will not expand when encountering expansion media. The insert prevents the hollow cavity from closing up when impacting sheet metal and preserves the terminal performance characteristics of the bullet.

Previous pistol bullet designs have employed a hard polymer sphere in the nose of a bullet, which will not provide the low velocity performance improvements that the above described design will. The cavity in prior art bullets is believed to be too small or of the wrong shape to be effective at low velocities, and the ball material is too hard to provide adequate transfer of the available hydrostatic forces. Higher velocity rifle projectiles with a tip and shank have traditionally had tips made from either metal or hard plastic. Although these materials provide adequate results at high velocities, they provide no performance advantages at lower velocities associated with longer range impacts.

Testing has also shown that the relatively soft insert materials provide higher bullet retained weight for both high and low velocity bullets after impacting expansion media. This increase is associated with the softer material's ability to distribute forces more uniformly and help prevent localized high sheer forces that cause bullets to lose jacket and core material when they impact expansion media.

While the above is discussed in terms of preferred and alternative embodiments, the invention is not intended to be so limited.

The invention claimed is:

1. A firearm ammunition component comprising:

an elongated body;

the body having a forward end;

the body having a rear end opposite the forward end;

the body having an intermediate cylindrical portion between the rear and forward ends;

the front end of the body defining a cavity;

a resilient nose element, at least a portion of which is received in the cavity, wherein the nose element is an elastomer that can be compressed to less than 50% of its length repeatedly without permanent deformation; and wherein the nose element is an elongated body having opposed ends.

2. The component of claim 1 wherein the nose element is an elastomer having a Shore A hardness less than or equal to 90.

3. The component of claim 1 wherein the nose element is an elastomer having a Shore A hardness greater than or equal to 50.

4. The component of claim 1 wherein the cavity has a length to diameter ratio of at least 1.5 and the nose element has a length to diameter ratio of at least 1.5.

5. The component of claim 1 wherein the nose element is selected from the group consisting of any synthetic or natural elastomer including rubber and silicone, metal and other springs, and compressible gas-filled bladders and bellows.

6. The component of claim 1 wherein the body has a caliber having a velocity, wherein the nose element is an elastomer having a Shore A hardness less than or equal to 55 when the velocity of the caliber of the body is 700-800 ft./s.

7. The component of claim 1 wherein the body has a caliber having a velocity, wherein the nose element is an elastomer having a Shore A hardness less than or equal to 80 when the velocity of the caliber of the body is 1200-1500 ft./s.

8. The component of claim 1 wherein the body has a caliber having a velocity, wherein the nose element is an elastomer having a Shore D hardness greater than or equal to 55 and less than or equal to 90 when the velocity of the caliber of the body is 2500-3000 ft./s.

9. The component of claim 1 wherein the body has a cavity length/diameter ratio greater than or equal to 1.25.

10. The component of claim 1 wherein the body has a cavity length/diameter ratio less than or equal to 1.75.

11. A firearm ammunition component comprising:

an elongated body;

the body having a forward end;

the body having a rear end opposite the forward end;

the body having an intermediate cylindrical portion between the rear and forward ends;

the front end of the body defining a cavity;

a resilient nose element, at least a portion of which is received in the cavity;

wherein the nose element is an elongated body having opposed ends; and wherein the body has a caliber and the nose element is an elastomer having a Shore A hardness that is less than or equal to $1/100$ of an X-axis velocity function for the caliber of the body and greater than or equal to $1/500$ of the X-axis velocity function for the caliber of the body.

12. The component of claim 11 wherein the body has a caliber and the nose element is an elastomer having a Shore A hardness that is less than or equal to $1/140$ of an X-axis velocity function for the caliber of the body and greater than or equal to $1/325$ of the X-axis velocity function for the caliber of the body.

13. The component of claim 11 wherein the body has a caliber and the nose element is an elastomer having a Shore A hardness that is equal to $1/250$ of an X-Axis velocity function for the caliber of the body.

14. The component of claim 11 wherein the body has a caliber selected from the group consisting of .380 ACP, 9 mm, 38 Special, 40 S&W, and .45 ACP.

15. A firearm ammunition component comprising:

an elongated body;

the body having a forward end;

the body having a rear end opposite the forward end;

the body having an intermediate cylindrical portion between the rear and forward ends;

the front end of the body defining a cavity;

a resilient nose element, at least a portion of which is received in the cavity; and wherein the nose element is an elongated body having opposed ends, and wherein the body of the nose element is end-to-end symmetrical such that orientation is not critical for manufacturing.

16. The component of claim 15 wherein the nose element is an elastomer that can be compressed to less than 50% of its length repeatedly without permanent deformation.

17. The component of claim 15 wherein the nose element is an elastomer having a Shore A hardness less than or equal to 90.

18. The component of claim 15 wherein the nose element is an elastomer having a Shore A hardness greater than or equal to 50.

19. The component of claim 15 wherein the cavity has a length to diameter ratio of at least 1.5.

20. The component of claim 15 wherein the nose element has a length to diameter ratio of at least 1.5.

* * * * *

UNITED STATES PATENT AND TRADEMARK OFFICE

CERTIFICATE OF CORRECTION

PATENT NO. : 8,413,587 B2
APPLICATION NO. : 13/453877
DATED : April 9, 2013
INVENTOR(S) : David E. Emary It is certified that error appears in the above-identified patent and that said Letters Patent is hereby corrected as shown below:

Item (63) Related U.S. Application Data field on the left column of the Title Page, "11/130,97~~2~~, filed on May 1~~7~~, 2005" should read --11/130,97<u>6</u>, filed on May 1<u>6</u>, 2005--.

In the Specification
Column 1, line 10, "11/130,97~~2~~, filed May 1~~7~~," should read --11/130,97<u>6</u>, filed May 1<u>6</u>.--.

Signed and Sealed this
Sixteenth Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,413,587 B2
APPLICATION NO. : 13/453877
DATED : April 9, 2013
INVENTOR(S) : David E. Emary It is certified that error appears in the above-identified patent and that said Letters Patent is hereby corrected as shown below:

In the Specification

At column 7, line 2, "velocities that typical rifle bullets, with velocities under 1000" should read --velocities than typical rifle bullets, with velocities under 1000--.

At column 7, line 4, "handgun rounds used by common self defense pistols being" should read --handgun rounds used by common self-defense pistols being--.

At column 8, line 2, "cavity has a depth slightly more than the overall bullet length" should read --cavity has a depth slightly less than the overall bullet length,--.

At column 10, line 59, "high sheer forces that cause bullets to lose jacket and core" should read --high shear forces that cause bullets to lose jacket and core--.

Signed and Sealed this
Twenty-third Day of June, 2015

Michelle K. Lee

Michelle K. Lee
*Director of the United States Patent and Trademark Office*